US009197037B1

(12) United States Patent
Kachikawa

(10) Patent No.: US 9,197,037 B1
(45) Date of Patent: Nov. 24, 2015

(54) SPARK PLUG

(71) Applicant: NGK SPARK PLUG CO., LTD., Nagoya-shi, Aichi (JP)

(72) Inventor: Norihide Kachikawa, Seto (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/716,163

(22) Filed: May 19, 2015

(30) Foreign Application Priority Data

May 21, 2014 (JP) ..... 2014-104963

(51) Int. Cl.
*H01T 13/32* (2006.01)
*H01T 13/20* (2006.01)
*H01T 13/39* (2006.01)

(52) U.S. Cl.
CPC ..... *H01T 13/32* (2013.01); *H01T 13/20* (2013.01); *H01T 13/39* (2013.01)

(58) Field of Classification Search
CPC ..... H01T 13/20–13/39
See application file for complete search history.

(56) References Cited

U.S. PATENT DOCUMENTS 6,046,532 A * 4/2000 Matsutani ..... H01T 13/39 313/141
2010/0019644 A1 1/2010 Fukuzawa et al. ..... 313/141
2011/0043093 A1* 2/2011 Nunome ..... H01T 13/39 313/141
2012/0217864 A1* 8/2012 Sumoyama ..... H01T 13/39 313/141
2012/0299460 A1 11/2012 Kato ..... 313/143
2013/0200774 A1* 8/2013 Kikai ..... H01T 13/32 313/141
2015/0069902 A1* 3/2015 Kita ..... H01T 13/32 313/130

FOREIGN PATENT DOCUMENTS

JP 2004-015882 A 1/2004 ..... G06Q 50/00
JP 2010-80059 A 4/2010 ..... H01T 13/20
JP 2012-160351 A 8/2012 ..... H01T 13/20
JP 2013-12462 A 1/2013 ..... H01T 13/32
JP 2013-222676 A 10/2013 ..... H01T 13/32

* cited by examiner

*Primary Examiner* — Mariceli Santiago
(74) *Attorney, Agent, or Firm* — Kusner & Jaffe

(57) ABSTRACT

A spark plug includes a portion from a position at a distance of 0.1 mm from a base end to a distal end that is categorizable into a high hardness portion and a low hardness portion using a hardness distribution of a ground electrode, the high hardness portion being a portion from the position at a distance of 0.1 mm from a base end to a position at a distance of 0.1×n (mm) from a base end, the low hardness portion being a portion from a position at a distance of 0.1×(n+1) (mm) from the base end to the distal end, where "n" is a natural number. The low hardness portion includes a portion that has a largest curvature in the ground electrode. A highest hardness of the low hardness portion is lower than a lowest hardness of the high hardness portion.

12 Claims, 7 Drawing Sheets

50
54
30p
52
SEALING GROUND ELECTRODE MEMBER WITH UPRIGHT POSITION BY WELDING (SEALING PROCESS)
300
310
320
INCLINING GROUND ELECTRODE MEMBER (FIRST BENDING PROCESS)
400
420
MAKING GROUND ELECTRODE MEMBER UPRIGHT (SECOND BENDING PROCESS)
10
20
30
500
520
(THIRD BENDING PROCESS)
30b

FIG. 6

| SAMPLE | DISTANCE FROM BASE END TO BREAKAGE POSITION (mm) | COUNT OF GROUND ELECTRODES WITH BREAKAGE | DETERMINATION | LOWEST HARDNESS IN RANGE FROM BASE END TO POSITION AT DISTANCE OF 3 mm HV1(Hv) | HARDNESS OF BENDED PORTION HV2(Hv) | Δ HV = HV1−HV2 (Hv) |
|---|---|---|---|---|---|---|
| SP01 | 1 | 0/100 | EXCELLENT | 290 | 190 | 100 |
| | 2 | 0/100 | EXCELLENT | | | |
| | 3 | 1/100 | GOOD | | | |
| | 4 | 1/100 | GOOD | | | |
| SP02 | 1 | 0/100 | EXCELLENT | 260 | 190 | 70 |
| | 2 | 1/100 | GOOD | | | |
| | 3 | 2/100 | GOOD | | | |
| | 4 | 3/100 | GOOD | | | |
| SP03 | 1 | 1/100 | GOOD | 220 | 200 | 20 |
| | 2 | 2/100 | GOOD | | | |
| | 3 | 1/100 | GOOD | | | |
| | 4 | 2/100 | GOOD | | | |
| SP10 (COMPARATIVE EXAMPLE) | 1 | 6/100 | POOR | 180 | 180 | 0 |
| | 2 | 7/100 | POOR | | | |
| | 3 | 6/100 | POOR | | | |
| | 4 | 2/100 | GOOD | | | |

DETERMINATION CRITERIA
EXCELLENT: 0/100
GOOD: 1/100 TO 3/100
POOR: 4/100 OR MORE

| SAMPLE | HARDNESS OF MOST BASE END PORTION OF GROUND ELECTRODE (Hv) | TEMPERATURE OF SEALING SURFACE OF METAL SHELL (°C) | DETERMINATION |
|---|---|---|---|
| SP04 | 400 | 600 | △ |
| SP01 | 290 | 580 | ○ |
| SP02 | 260 | 550 | ○ |
| SP03 | 220 | 520 | ○ |
| SP10 (COMPARATIVE EXAMPLE) | 180 | 500 | ○ |

DETERMINATION CRITERIA
GOOD: LESS THAN 650°C
POOR: EQUAL TO OR MORE THAN 650°C

SPARK PLUG

RELATED APPLICATIONS

This application claims priority from Japanese Patent Application No. 2014-104963 filed with the Japan Patent Office on May 21, 2014, the entire content of which is hereby incorporated by reference.

FIELD OF THE INVENTION

The present invention relates to a spark plug.

BACKGROUND OF THE INVENTION

In general, a spark plug includes a center electrode and a ground electrode that are disposed at a distal end side of the spark plug. The center electrode projects from a distal end of an insulator and is held in an axial hole of the insulator. On the other hand, the ground electrode is sealed to a distal end portion of a metal shell.

One of properties required for a spark plug is the breakage resistance of the ground electrode. Conventionally, a variety of techniques have been proposed in order to enhance the breakage resistance of the ground electrode (refer to the following Patent Literatures).

JP-A-2013-222676 discloses a technique that enhances the breakage resistance of the ground electrode by disposing a large width portion at a portion of the ground electrode. JP-A-2013-012462 discloses a technique that enhances the breakage resistance of the ground electrode by adjusting the thickness of the ground electrode in the radial direction. JP-A-2012-160351 discloses a technique that enhances the breakage resistance of the ground electrode by disposing a depressed portion at a back surface or a side surface of a bending portion of the ground electrode, and increasing the hardness of a bottom of the depressed portion. JP-A-2010-80059 discloses a technique that enhances the breakage resistance of the ground electrode by disposing a needle-shaped electrode tip in the ground electrode.

SUMMARY OF THE INVENTION

In accordance with a first aspect of the present invention, there is provided a spark plug having a pipe-shaped insulator having an axial hole that passes through the insulator in an axial direction; a center electrode projecting from a distal end of the insulator; a metal shell covering a peripheral portion of the insulator; and a ground electrode whose base end portion is sealed to a distal end portion of the metal shell. The ground electrode has a bent portion that is bended such that a distal end portion of the ground electrode is disposed with being spaced from a distal end portion of the center electrode. A hardness distribution is obtained by cutting the ground electrode from a distal end to a base end of the ground electrode at a cutting plane including an axial line of the spark plug and passing through a center of the ground electrode, and then measuring hardness of the ground electrode at a plurality of positions disposed with a distance from the base end of the ground electrode along a center line of the cutting plane of the ground electrode, the distance increasing in increments of 0.1 mm. As used herein, "n" is a natural number. A portion of the ground electrode from a position at a distance of 0.1 mm from the base end along the center line to the distal end is categorizable into a high hardness portion and a low hardness portion using the hardness distribution, the high hardness portion being a portion from the position at a distance of 0.1 mm from the base end along the center line to a position at a distance of 0.1×n (mm) from the base end along the center line, the low hardness portion being a portion from a position at a distance of 0.1×(n+1) (mm) from the base end along the center line to the distal end. The low hardness portion includes a portion that has a largest curvature in the ground electrode. A highest hardness of the low hardness portion is lower than a lowest hardness of the high hardness portion.

BRIEF DESCRIPTION OF THE DRAWINGS

FIG. 6 is an explanatory view illustrating a result of a breakage resistance test for various kinds of samples.

DETAILED DESCRIPTION OF THE PREFERRED EMBODIMENTS

Figure 1:
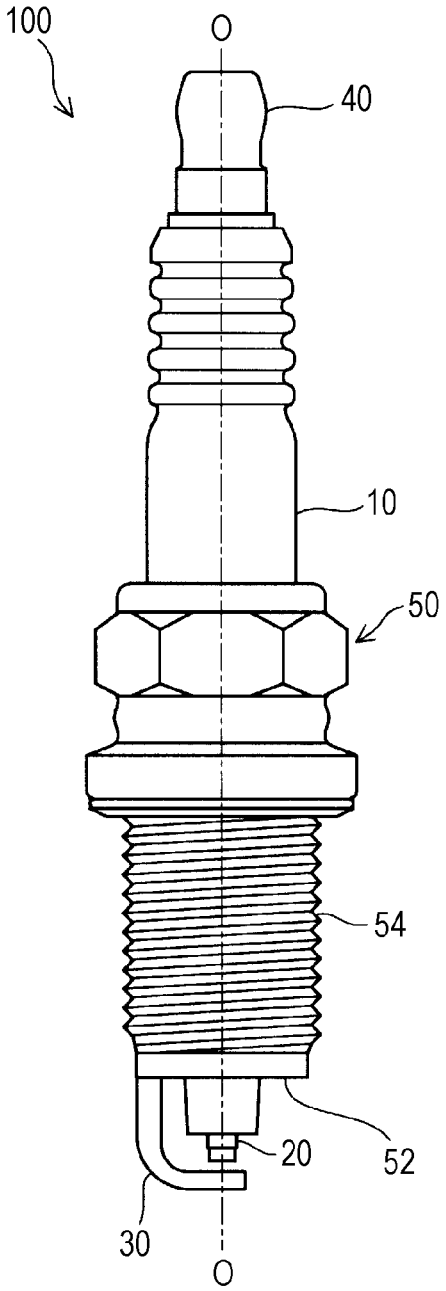
FIG. 1 is a front view illustrating a spark plug according to one embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The above-described conventional techniques require a quite substantial change in the shape or the structure of the ground electrode. Therefore, a technique has been conventionally desired that enhances the breakage resistance of the ground electrode using an approach other than the above-described techniques. The ground electrode is bended to face a center electrode in a bending process. Accordingly, a technique is desired that enhances the breakage resistance of the ground electrode with maintaining the bending workability of the ground electrode.

This disclosure can be realized as the following forms.

(1) According to one embodiment of this disclosure, a spark plug is provided including: a pipe-shaped insulator having an axial hole that passes through the insulator in an axial direction; a center electrode projecting from a distal end of the insulator; a metal shell covering a peripheral portion of the insulator; and a ground electrode whose base end portion is sealed to a distal end portion of the metal shell. The ground electrode having a bended portion that is bended such that a distal end portion of the ground electrode is disposed and spaced from a distal end portion of the center electrode. In this spark plug, a hardness distribution is obtained by cutting the ground electrode from a distal end to a base end of the ground electrode at a cutting plane including an axial line of the spark plug and passing through a center of the ground electrode, and then measuring hardness of the ground electrode at a plurality of positions disposed with a distance from the base end of the ground electrode along a center line of the cutting plane of the ground electrode, the distance increasing in increments of 0.1 mm. As used herein, "n" is a natural number. A portion of the ground electrode from a position at a distance of 0.1 mm from the base end along the center line to the distal end is categorizable into a high hardness portion and a low hardness portion using the hardness distribution, the high hardness portion being a portion from the position at a distance of 0.1 mm from the base end along the center line to a position at a distance of 0.1×n (mm) from the base end along the center line, the low hardness portion being a portion from a position at a distance of 0.1×(n+1) (mm) from the base end along the center line to the distal end. The low hardness portion includes a portion that has a largest curvature in the ground electrode. A highest hardness of the low hardness portion is lower than a lowest hardness of the high hardness portion. According to this spark plug, the breakage resistance of the ground electrode can be enhanced with maintaining the bending workability of the ground electrode.

(2) In the hardness distribution, the spark plug may have hardness of the high hardness portion that is higher than hardness of the portion that has the largest curvature. According to this spark plug, the breakage resistance of the ground electrode can be enhanced.

(3) In the hardness distribution, the spark plug may have a distal end portion of the high hardness portion being an opposite side of the base end that has the lowest hardness of the high hardness portion. According to this spark plug, the bending workability of the ground electrode can be enhanced.

(4) In the spark plug, the high hardness portion may at least include a portion to a position at a distance of 3 mm from the base end along the center line. According to this spark plug, the breakage resistance of the ground electrode can be enhanced.

(5) In the hardness distribution, the spark plug may have the lowest hardness of the high hardness portion from a position at a distance of 0.1 mm from the base end along the center line to the position at the distance of 3 mm from the base end along the center line that is higher than hardness of the portion that has the largest curvature in the ground electrode by equal to or more than 20 Hv. According to this spark plug, the breakage resistance of the ground electrode can be further enhanced.

(6) In the hardness distribution, the spark plug may have hardness at the position at a distance of 0.1 mm from the base end along the center line and hardness at a position at a distance of 0.1×n (mm) from the base end along the center line that are lower than a highest hardness of the high hardness portion.

Note that the position at a distance of 0.1 mm from the base end is equivalent to a position at the most base end side of the high hardness portion. The position at a distance of 0.1×n (mm) from the base end is equivalent to a position at the most distal end side of the high hardness portion. According to the above-described spark plug, the thermal conduction between the ground electrode and the metal shell can be increased by making the hardness at the position at the most base end side of the high hardness portion lower than the highest hardness of the high hardness portion. This increases the heat conductivity of the ground electrode. The bending workability of the ground electrode can be enhanced by making the hardness at the position at the most distal end side of the high hardness portion lower than the highest hardness of the high hardness portion.

Note that the technique of this disclosure can be realized in various embodiments. The technique according to this disclosure can be realized, for example, in the form of a method for fabricating a spark plug, or a method for fabricating a metal shell for the spark plug.

FIG. 1 is a front view illustrating a spark plug 100 according to one embodiment of this disclosure. In an explanation of FIG. 1, the lower side, where a firing end of the spark plug 100 is disposed, is defined as a distal end 30*e* side of the spark plug 100, and the upper side is defined as a rear end side of the spark plug 100. The spark plug 100 includes an insulator 10, a center electrode 20, a ground electrode 30, a terminal metal fitting 40 and, a metal shell 50. The insulator 10 includes an axial hole extending along an axial line O. Note that the axial line O is also referred to as a central axis. The center electrode 20 is a rod-shaped electrode extending along the axial line O. The center electrode 20 is held by the insulator 10 with being inserted into the axial hole of the insulator 10. One end of the ground electrode 30 is fixed to a distal end portion 52 of the metal shell 50. The other end of the ground electrode 30 is opposed to the center electrode 20. The terminal metal fitting 40 is a terminal nut for receiving electric power supply, and is electrically connected to the center electrode 20. The metal shell 50 is a pipe-shaped member covering a peripheral portion of the insulator 10. The insulator 10 is fixed in the metal shell 50. A thread portion 54 is formed at an outer peripheral portion of the metal shell 50. The thread portion 54 is a portion where a thread ridge is formed. The thread portion 54 is threadably mounted in a thread hole of an engine head when the spark plug 100 is mounted to the engine head.

Figures 2A, 2B, 2C, 2D, 2E, 2F, 2G, 2H, 2I:
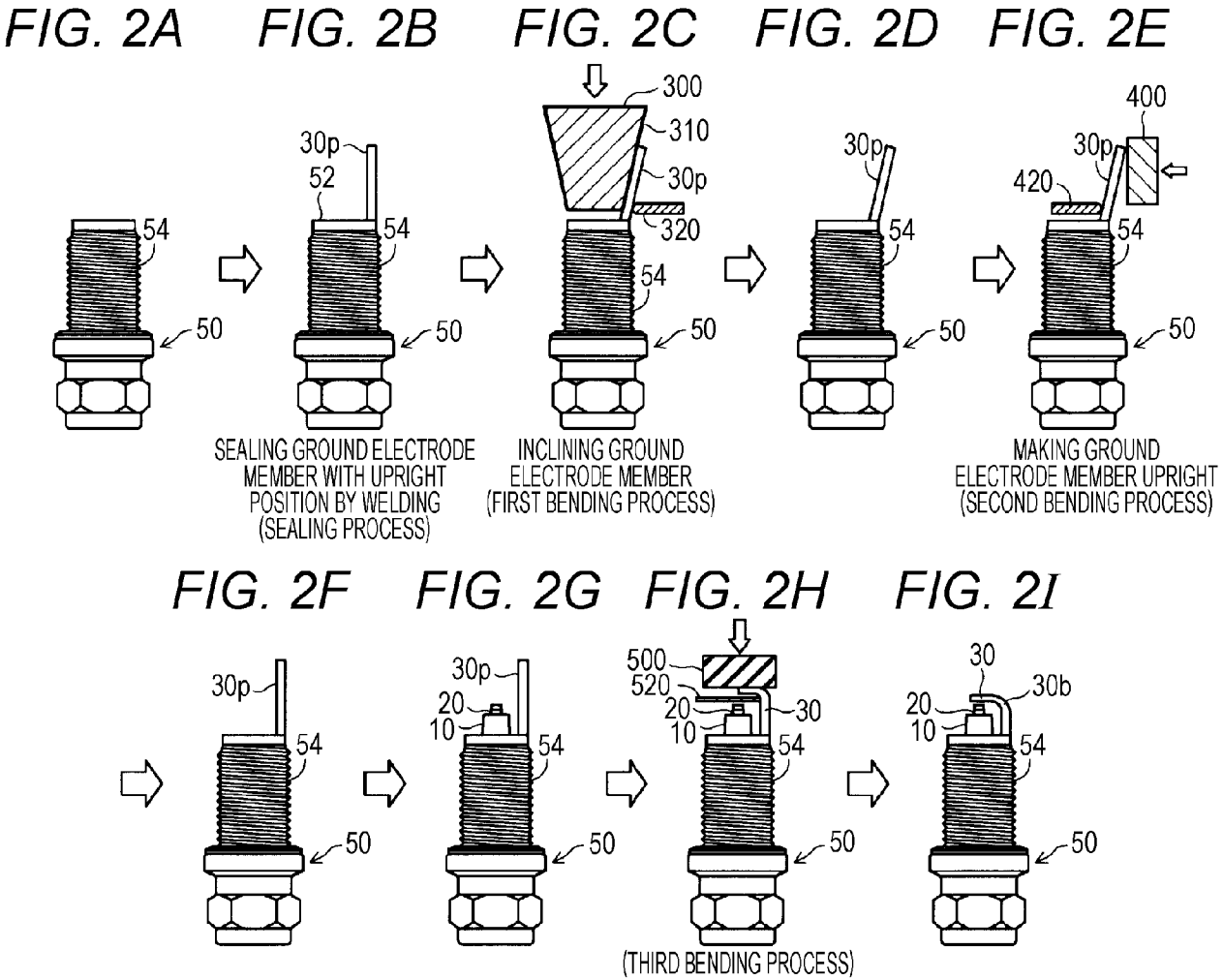
FIGS. 2A to 2I are explanatory views illustrating a part of fabrication processes of the spark plug.

FIGS. 2A to 2I illustrate a part of fabrication processes of the spark plug according to one embodiment. FIG. 2A illustrates a process for preparing the metal shell 50 before the ground electrode 30 is sealed (i.e., secured) to the metal shell 50. FIG. 2B illustrates a sealing process for sealing a linearly extending rod-shaped ground electrode member 30*p* to the distal end portion 52 of the metal shell 50 with upright position. Note that the upright position of the ground electrode member 30*p* means a state in which the ground electrode member 30*p* is in a direction parallel to the axial line O (FIG. 1) of the metal shell 50. This sealing process is carried out using, for example, resistance welding. FIG. 2C illustrates a process for inclining the ground electrode member 30*p* using a push jig 300 and an auxiliary jig 320. This process is equivalent to a first manufacturing process of bending processes for bending the ground electrode member 30*p*. A side surface 310 of the push jig 300 is a planar surface that is inclined with respect to the central axis of the metal shell 50 with predetermined angle. The push jig 300, for example, moves from the distal end side (the upper side in the drawing) toward the rear end side (the lower side in the drawing) in the central axial direction of the metal shell 50 while the auxiliary jig 320 supports the outside portion of the ground electrode member 30*p*. This can incline the ground electrode member 30*p* along the side surface 310 of the push jig 300. The auxiliary jig 320 may not be necessarily used. FIG. 2D illustrates a state in which the ground electrode member 30*p* is inclined with being sealed to the metal shell 50.

FIG. 2E illustrates a manufacturing process for making upright the ground electrode member 30*p* again using a push jig 400 and an auxiliary jig 420. This process is equivalent to a second manufacturing process of the bending processes for bending the ground electrode member 30*p*. The push jig 400, for example, moves from the outside of the metal shell 50 toward the inside of the metal shell 50 while the auxiliary jig 420 supports the inside portion of the ground electrode member 30*p*. This can make upright the ground electrode member 30*p*. The auxiliary jig 420 may not be necessarily used. FIG. 2F illustrates a state in which the ground electrode member 30*p* stands in the upright position again with being sealed to the metal shell 50.

FIG. 2G illustrates a crimping process. In this process, the insulator 10 in which the center electrode 20 is assembled is inserted into the metal shell 50. Furthermore, the insulator 10 is fixed to the metal shell 50 by crimping a crimped portion (not illustrated) at the rear end of the metal shell 50.

FIG. 2H illustrates a bending process for bending the ground electrode member 30*p* to make a final bending shape using a push jig 500 and an auxiliary jig 520. This process is equivalent to a third manufacturing process of the bending processes for bending the ground electrode member 30*p*. The push jig 500, for example, moves from the distal end side (the upper side in the drawing) toward the rear end side (the lower side in the drawing) of the metal shell 50 while the auxiliary jig 520 supports the inside portion of the ground electrode member 30*p*. This can bend the ground electrode member 30*p* to make a final shape of the ground electrode 30. The auxiliary jig 520 may not be necessarily used. FIG. 2I illustrates the ground electrode 30 having a bended portion 30*b* that is obtained by bending the ground electrode member 30*p*. The bended portion 30*b* is a portion that has the largest curvature in the ground electrode 30. In the third manufacturing process of FIG. 2H, the rod-shaped ground electrode member 30*p* may be bended in one step. Alternatively, in the third manufacturing process, the rod-shaped ground electrode member 30*p* may be bended in two steps, which are pre-bending step and final bending step.

As described below, the hardness of the high hardness portion (described below) of the ground electrode 30 can be increased by bending the ground electrode member 30*p* in the manufacturing processes described with reference to FIGS. 2A to 2I. Consequently, the breakage resistance of the ground electrode 30 can be enhanced. In the first manufacturing process illustrated in FIG. 2C, as the inclined angle of the ground electrode member 30*p* increases, the hardness of the high hardness portion of the final ground electrode 30 can be higher. The range of the high hardness portion can be controlled by adjusting the height (a position along the axial line O of the spark plug) of the auxiliary jig 320 illustrated in FIG. 2C and/or the height of the auxiliary jig 420 illustrated in FIG. 2E. The range of the high hardness portion can be larger, for example, by placing the height of the auxiliary jig 320 upper in FIG. 2C. As a result, the high hardness portion can be extended toward the more distal end side of the ground electrode 30.

Figure 3A:
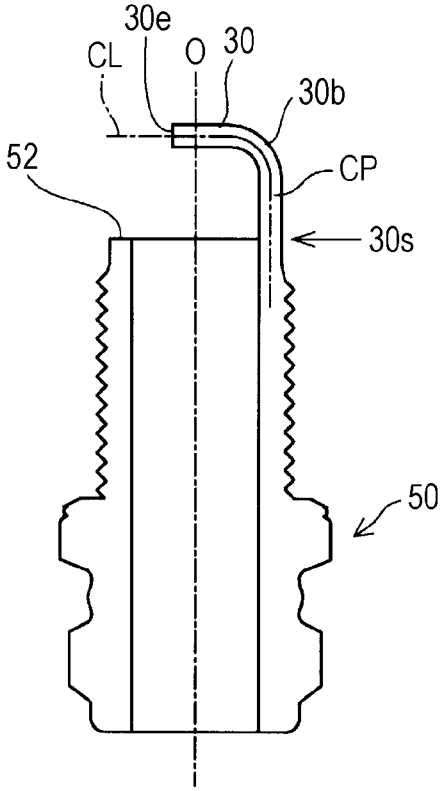
FIGS. 3A and 3B are explanatory views illustrating a cutting plane used for hardness measurement.
Figure 3B:
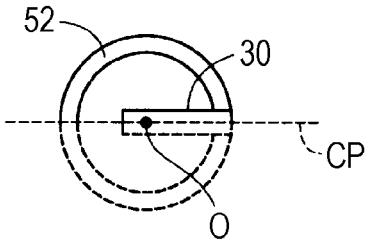

FIGS. 3A and 3B are explanatory views illustrating a cutting plane used for measuring the hardness of the ground electrode 30. A cutting plane CP of the ground electrode 30 is a surface obtained by cutting the ground electrode 30 along a surface that includes the axial line O of the spark plug with passing through the center of the ground electrode 30. In the hardness measurement test, a portion from the distal end 30*e* to a base end 30*s* of the ground electrode 30 is cut along the cutting plane CP. After that, the hardness of the ground electrode 30 is measured at positions in increments of 0.1 mm along a center line CL of the cutting plane CP of the ground electrode 30. Note that the center line CL of the cutting plane CP means a line that extends through the center of the cutting plane CP of the ground electrode 30. The hardness measurement test is carried out in accordance with the Micro Vickers hardness test that is specified in Japanese Industrial Standard Z2244. In the test, test force is 980.7 mN, holding time is 15 seconds, and indenter approach speed is 60 m/s.

Figure 4:
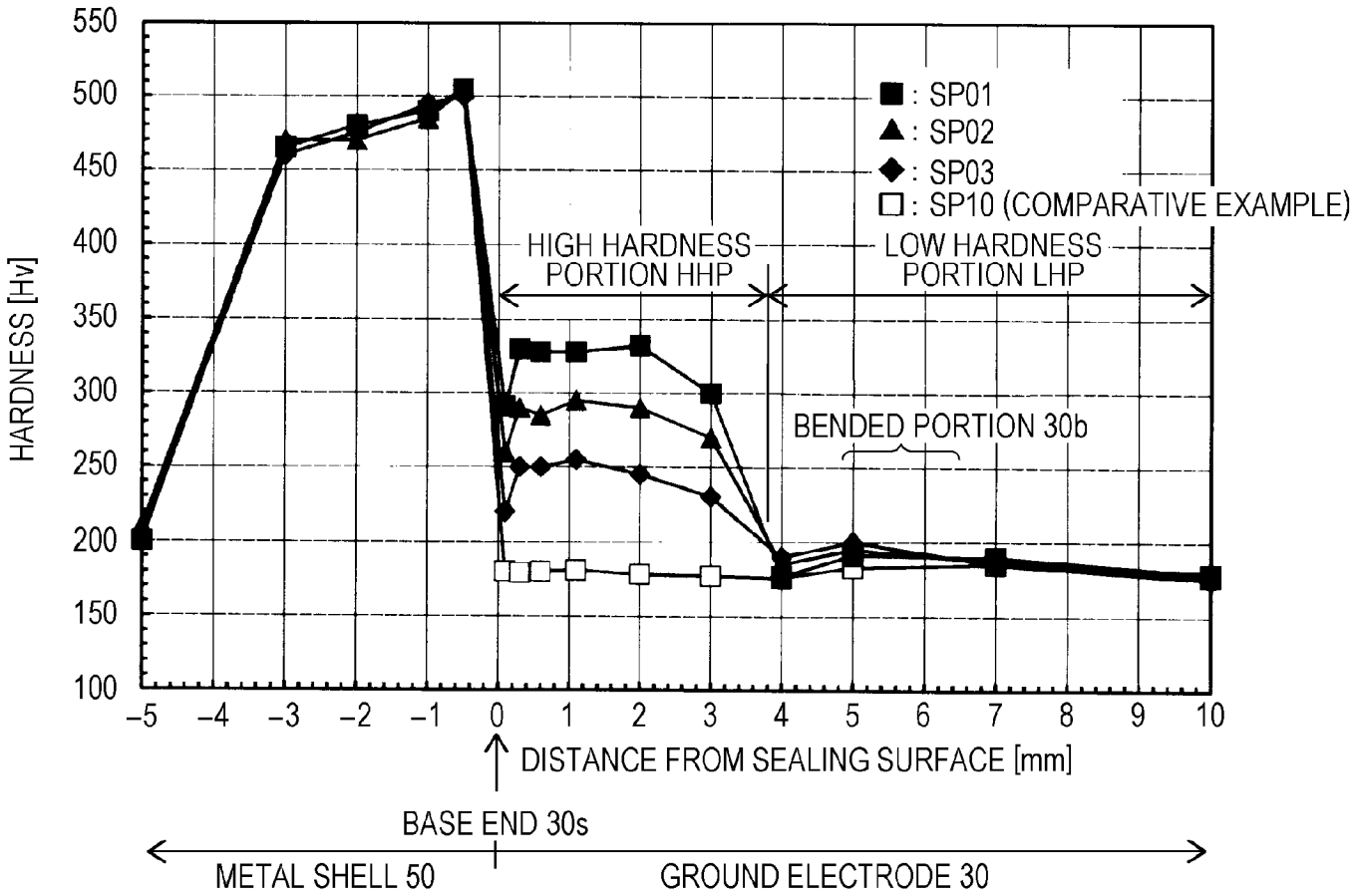
FIG. 4 is a graph illustrating a hardness distribution obtained by the hardness measurement.

FIG. 4 is a graph illustrating a hardness distribution obtained by the hardness measurement test for various kinds of samples. The horizontal axis indicates a distance from a sealing surface between the ground electrode 30 and the metal shell 50 to a measuring position, while the vertical axis indicates the hardness. A position of the sealing surface between the ground electrode 30 and the metal shell 50 is equivalent to a position of the base end 30*s* (FIGS. 3A and 3B) of the ground electrode 30. A position at a distance of 10 mm from the sealing surface is approximately equal to the distal end 30*e* (FIGS. 3A and 3B) of the ground electrode 30.

FIG. 4 illustrates the hardness distributions for four types of samples SP01 to SP03 and SP10. The samples SP01 to SP03 are samples in which the hardness of the ground electrode 30 is increased by the processes illustrated in FIGS. 2A to 2I. The sample SP10 is a sample as a comparative example that is fabricated without the first manufacturing process and the second manufacturing process illustrated in FIGS. 2C to 2F. In the samples SP01 to SP03, the hardness distribution of the ground electrode 30 is categorizable into a high hardness portion HHP and a low hardness portion LHP. The high hardness portion HHP exists near the base end 30*s* of the ground electrode 30, while the low hardness portion LHP exists at the distal end side of the ground electrode 30 from the high hardness portion HHP. The high hardness portion HHP is a portion that has the hardness higher than that of the low hardness portion LHP. Namely, the lowest hardness of the high hardness portion HHP is higher than the highest hardness of the low hardness portion LHP. The following is the reason why the high hardness portion HHP is formed. A portion equivalent to the high hardness portion HHP is bended in the first manufacturing process and the second manufacturing process illustrated in FIGS. 2C to 2F. Thus, the hardness of the portion equivalent to the high hardness portion HHP is increased by the work hardening of the high hardness portion HHP.

As described above, the hardness is measured at the positions along the center line CL, the positions being spaced in increments of 0.1 mm Therefore, the high hardness portion HHP extends from a position at a distance of 0.1 mm from the base end 30*s* of the ground electrode 30 to a position at a distance of 0.1×n (mm) from the base end 30*s*, wherein "n" is an arbitrary natural number. While, the low hardness portion LHP extends from a position at a distance of 0.1×(n+1) (mm) from the base end 30*s* of the ground electrode 30 to the distal end 30*e* of the ground electrode 30. As described later, it is preferred that "n" is equal to or more than 30 (namely, the high hardness portion HHP extends to a position at a distance of 3 mm from the base end 30*s*).

The high hardness portion HHP of the ground electrode 30 has a function that enhances the breakage resistance of the ground electrode 30. On the other hand, the low hardness portion LHP has a function that maintains or enhances the bending workability thereof during the bending process (the third manufacturing process in FIG. 2H) for forming the bended portion 30*b*. Namely, the ground electrode 30 is relatively breakable at a portion close to the base end 30*s*. Therefore, this portion can be changed to the high hardness portion HHP to enhance the breakage resistance thereof. On the other hand, a portion at the distal end side from the high hardness portion HHP can be changed to the low hardness portion LHP to maintain or enhance the bending workability thereof.

The following is the reason why the hardness of the high hardness portions HHP of the three kinds of samples SP01 to SP03 are different from one another. Namely, the inclined angles of the ground electrode members 30*p* of the three kinds of samples SP01 to SP03 bended in the first manufacturing process of FIG. 2C are different from one another. Accordingly, each sample has different degree of work hardening. In general, as the inclined angle of the ground electrode member 30*p* bended (bent) in the first manufacturing process of FIG. 2C increases, the hardness of the high hardness portion HHP can be higher. A portion showing the highest hardness of the low hardness portion LHP exists in the bended portion 30*b* (FIGS. 3A and 3B). A reason why the bended portion 30*b* has high hardness is that the hardness of the bended portion 30*b* is increased due to work hardening when the bended portion 30*b* is formed in the third manufacturing process illustrated in FIG. 2H. In this example, the hardness of the bended portion 30*b* is in the range of 180 Hv to 200 Hv. The high hardness portion HHP is a portion having hardness higher than the hardness of this bended portion 30*b* (a portion that has the largest curvature in the ground electrode 30).

As shown in FIG. 4, the hardness of a portion of the metal shell 50 that is close to the sealing surface between the ground electrode 30 and the metal shell 50 shows extremely high value, which is 450 Hv to 500 Hv. The following is this reason. Namely, in the sealing process of FIG. 2B, the metal shell 50 is heated to high temperature, and then is rapidly cooled when the ground electrode member 30*p* is sealed to the metal shell 50 by the resistance welding. This rapid cooling causes quench hardening to increase the hardness of the metal shell 50. The measurement samples used to obtain the measurement result illustrated in FIG. 4 have the ground electrode 30 whose material is different from a material of the metal shell 50. Therefore, increase in hardness due to quench hardening that occurs in the metal shell 50 does not occur in the ground electrode 30. As described later, if the hardness of the ground electrode 30 increases excessively, the heat conductivity of the ground electrode 30 decreases. Accordingly, the ground electrode 30 is preferably made of a material whose hardness does not increase excessively by quench hardening.

Figure 5:
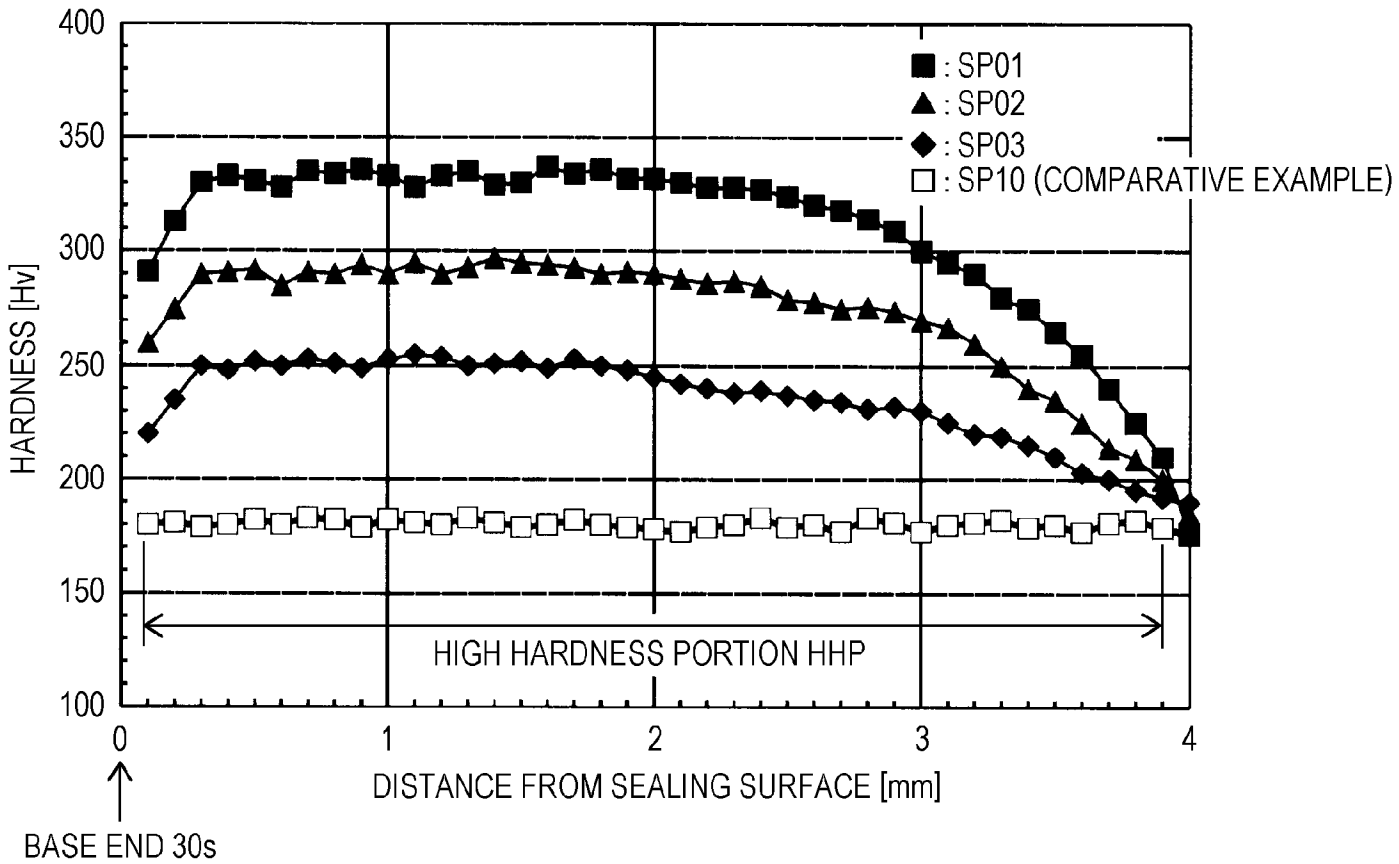
FIG. 5 is a graph that enlarges a part of FIG. 4.

FIG. 5 enlarges the measurement results at positions in the graph of FIG. 4 from the base end 30*s* of the ground electrode 30 to a position at a distance of 4 mm from the base end 30*s*. As a comparative example, the hardness of the sample SP10 in the above described range is approximately constant at 180 Hv. On the other hand, the hardness of the samples SP01 to SP03 is slightly low at the position at a distance of 0.1 mm from the base end 30*s* of the ground electrode 30 (the position at the most base end side of the high hardness portion HHP). The hardness distribution of the samples SP01 to SP03 is categorizable into three portions, a first portion, a second portion, and a third portion. In the first portion, the hardness increases as a distance from the base end 30*s* increases. In the second portion, which exists at the distal end side from the first portion, the hardness is approximately constant and flat. In the third portion, which exists at the distal end side from the second portion, the hardness gradually decreases. The first portion, in which the hardness increases, extends from the position at a distance of 0.1 mm from the base end 30*s* of the ground electrode 30 to a position at a distance of 0.3 mm from the base end 30*s*. The flat second portion extends from the position at a distance of 0.3 mm from the base end 30*s* to a position at a distance of 1.8 mm from the base end 30*s*. The third portion, in which the hardness decreases, extends from the position at a distance of 1.8 mm from the base end 30*s* to the position at a distance of 4 mm from the base end 30*s*. In each of the samples SP01 to SP03, the hardness at the position at the most base end 30*s* side in the high hardness portion HHP for a sample and the hardness at the position at a distance of 3 mm from the base end 30*s* for the same sample show approximately equal value, which is relatively high value.

A position at a distance of 3.9 mm from the base end 30*s* of the ground electrode 30 is equivalent to a position at the distal end side in the high hardness portion HHP, which is opposite side of the base end 30*s* of the ground electrode 30. The high hardness portion HHP preferably has the lowest hardness at the distal end of the high hardness portion HHP. The reason is that if the high hardness portion HHP has the lowest hardness at the distal end portion of the high hardness portion HHP, bending workability of a portion at further distal end side thereof (namely, the low hardness portion LHP) can be enhanced.

The position in the high hardness portion HHP at a distance of 0.1 mm from the base end 30*s* of the ground electrode 30 is equivalent to the position at the most base end side of the high hardness portion HHP. It is preferred that the hardness at the position at the most base end side of the high hardness portion HHP and the hardness at the position at the most distal end side of the high hardness portion HHP are lower than the highest hardness of the high hardness portion HHP. The following is the reason. Namely, the thermal conduction between the ground electrode 30 and the metal shell 50 can be enhanced by making the hardness at the position at the most base end side of the high hardness portion HHP lower than the highest hardness of the high hardness portion HHP. This increases the heat conductivity of the ground electrode 30. The bending workability of the ground electrode 30 can be enhanced by making the hardness at the position at the most distal end side of the high hardness portion HHP lower than the highest hardness of the high hardness portion HHP. The test result regarding the heat conductivity of the ground electrode 30 will be described later.

As shown in FIG. 4, in the samples SP01 to SP03, the value of the highest hardness in the low hardness portion LHP is 190 Hv to 200 Hv. On the other hand, the high hardness portion HHP is a portion that has the hardness higher than the highest hardness of the low hardness portion LHP. Therefore, in the example of FIG. 5, the high hardness portion HHP extends from the position at a distance of 0.1 mm from the base end 30*s* of the ground electrode 30 to the position at a distance of 3.9 mm from the base end 30*s*. As described above, the range of the high hardness portion HHP, however, can be controlled by adjusting the height of the auxiliary jig 320 in FIG. 2C and/or the height of the auxiliary jig 420 of FIG. 2E. As described in detail below, in terms of the breakage resistance, it is preferred that the high hardness portion HHP at least includes the range from the position at a distance of 0.1 mm from the base end 30*s* of the ground electrode 30 to the position at a distance of 3 mm from the base end 30*s*.

FIG. 6 illustrates the result of the breakage resistance test for four types of samples SP01 to SP03 and SP10 illustrated in FIGS. 4 and 5. The breakage resistance test is carried out based on "ISO 11565 3.4.4" as follows: Namely, the samples are vibrated with an acceleration of 30 G in the horizontal direction and the vertical direction respectively for 8 hours (16 hours in total). During the vibration, the vibration frequency sweeps back and forth between 50 Hz and 500 Hz at a changing rate of one octave per minute. After that, the existence of breakage in the ground electrode 30 is checked. For example, as the sample SP01, one hundred samples are made under the identical condition. The breakage resistance test is carried out with these one hundred samples. The same applies to the other samples SP02, SP03, and SP10.

The left half of FIG. 6 illustrates: a position where a breakage is caused during the breakage resistance test; a count of samples that have a breakage caused; and a determination result of the breakage resistance test for the four types of samples SP01 to SP03 and SP10. The right half of FIG. 6 illustrates, for reference: the lowest hardness HV1 in the range from the base end 30*s* of the ground electrode 30 to the position at a distance of 3 mm from the base end 30*s*; the hardness HV2 of the bended portion 30*b*; and the difference ΔHV (=HV1−HV2) between them.

In the case of the sample SP10, which is the comparative example, twenty-one samples out of one hundred samples have a breakage. Six samples have a breakage at the position at a distance of 1 mm from the base end 30*s*. Six samples have a breakage at the position at a distance of 3 mm from the base end 30*s*. Seven samples have a breakage at the position at a distance of 2 mm from the base end 30*s*. Two samples have a breakage at the position at a distance of 4 mm from the base end 30*s*. As understood from these results, a breakage occurs mainly at the positions at a distance of equal to or less than 3 mm from the base end 30*s*. Accordingly, the breakage resistance of the ground electrode 30 can be enhanced by increasing the hardness at the positions at a distance of equal to or less than 3 mm from the base end 30*s*.

In the case of the samples SP01 to SP03, two to six samples out of one hundred samples have a breakage. These numbers are substantially fewer than the count of the samples SP10 with a breakage, which is the comparative example. In this method, the samples SP01 to SP03 having the high hardness portion HHP show the enhanced breakage resistance as compared with the sample SP10 as the comparative example. As described above, in the case of the sample SP10, which is the comparative example, a breakage easily occurs at the positions at a distance of equal to or less than 3 mm from the base end 30*s*. Accordingly, in terms of the breakage resistance, it is preferred that the high hardness portion HHP at least includes the range from the position at a distance of 0.1 mm from the base end 30*s* of the ground electrode 30 to the position at a distance of 3 mm from the base end 30*s*.

Among the three kinds of samples SP01 to SP03, the first sample SP01 shows the most satisfactory breakage resistance. The second sample SP02 and the third sample SP03 show the second most satisfactory breakage resistance. As shown in the right half of FIG. 6, in the case of the third sample SP03, the difference AHV between the lowest hardness HV1 in the range of the ground electrode 30 from the base end 30*s* to the position at a distance of 3 mm from the base end 30*s* and the hardness HV2 of the bended portion 30*b* is 20 Hv. It is possible to obtain higher breakage resistance than the breakage resistance of the sample SP10, which is the comparative example, if the high hardness portion HHP is formed in the ground electrode 30 even though the value of the difference AHV of the hardness is equal to or less than 20 Hv. The difference AHV, however, is preferably equal to or more than 20 Hv for further enhancing the breakage resistance.

Figures 7A, 7B:
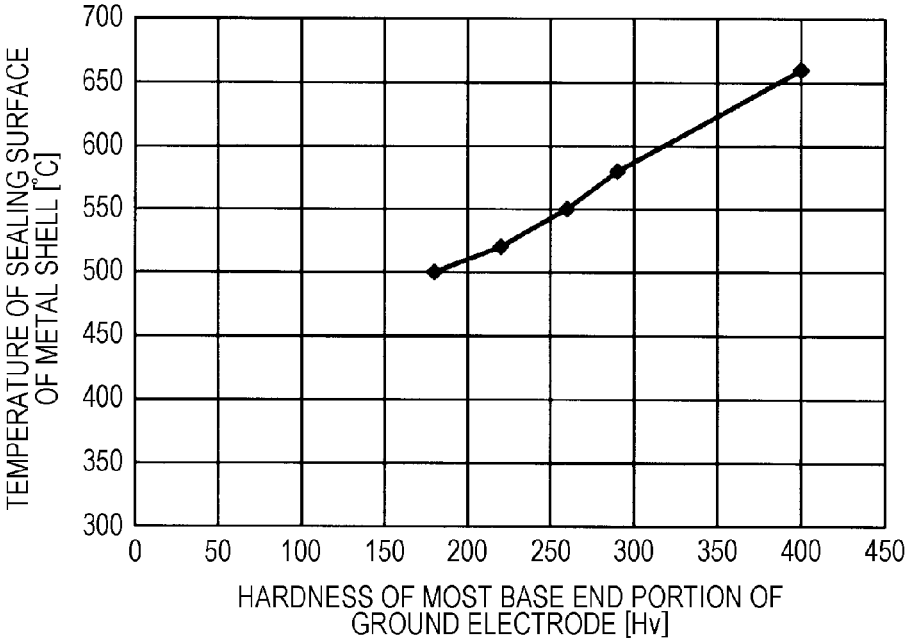
FIGS. 7A and 7B are explanatory views illustrating a result of a temperature test for sealing surfaces of metal shells of various kinds of samples.

FIGS. 7A and 7B are explanatory views illustrating the result of a temperature test for the sealing surfaces of the metal shells of the various kinds of samples. The horizontal axis of the graph in FIG. 7A indicates the hardness of the most base end portion of the ground electrode 30. The most base end portion of the ground electrode 30 means the portion at a distance of 0.1 mm from the base end 30*s* of the ground electrode 30 in FIG. 5. The vertical axis of the graph in FIG. 7B indicates the temperature of the sealing surface of the metal shell 50. In this test, the temperature of the sealing surface of the metal shell 50 is measured with maintaining the temperature of a portion at a distance of 10 mm from the base end 30*s* of the ground electrode 30 at 1000° C. The sealing surface of the metal shell 50 means an inner surface of the metal shell 50 that is equivalent to the base end 30*s* of the ground electrode 30 as shown in FIGS. 3A and 3B. However, the temperature of the sealing surface of the metal shell 50 is a value obtained by measuring, using a thermocouple, the temperature of the inner surface of the metal shell 50 at the position at a distance of 0.3 mm from the sealing surface.

The values of the hardness of the samples SP01 to SP03 and SP10 illustrated in FIGS. 7A and 7B are the identical values illustrated in FIGS. 4 and 5. FIGS. 7A and 7B also illustrate the result of the hardness measurement and temperature measurement of another kind of sample SP04 in addition to the samples SP01 to SP03 and SP10. In this sample SP04, the hardness of the most base end portion of the ground electrode 30 is 400 Hv, which is the highest among the all samples. As understood from the result of FIGS. 7A and 7B, as the hardness of the most base end portion of the ground electrode 30 increases, the temperature of the sealing surface of the metal shell 50 tends to be higher. The temperature of the sealing surface of the metal shell 50 is an index that indicates the heat conductivity of the ground electrode 30. Namely, as the temperature of the sealing surface of the metal shell 50 decreases, the ground electrode 30 preferably shows more excellent heat conductivity. Accordingly, in terms of the heat conductivity of the ground electrode 30, it is preferred that the hardness of the most base end portion of the ground electrode 30 is not excessively high. For example, the hardness of the most base end portion of the ground electrode 30 is preferably equal to or less than 300 Hv.

Modification

The disclosed technique is not limited to the working example and the embodiment described above. This disclosed technique can be implemented in various forms without departing the spirit of the disclosure.

Modification 1:

Regarding the spark plug, spark plugs having various configurations other than the configuration illustrated in FIG. 1 can be applied to the technique of this disclosure. In particular, specific forms of a terminal metal fitting and an insulator may have various shapes.

Modification 2:

In the above-described embodiment, the ground electrode member 30*p* is bended in the manufacturing processes of FIGS. 2A to 2I. The ground electrode member 30*p*, however, may be bended in other processes. Alternatively, another process other than these manufacturing processes may be added during the first to third manufacturing processes of the bending process illustrated in FIGS. 2C, 2E, and 2H. In particular, the plating process may be carried out on the metal shell 50 to which the ground electrode member 30*p* is sealed, for example, after the first manufacturing process (FIG. 2C) and before the second manufacturing process (FIG. 2E).

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

Having described the invention, the following is claimed:

1. A spark plug comprising:

a pipe-shaped insulator having an axial hole that passes through the insulator in an axial direction;

a center electrode projecting from a distal end of the insulator;

a metal shell covering a peripheral portion of the insulator; and a ground electrode whose base end portion is sealed to a distal end portion of the metal shell, the ground electrode having a bended portion that is bended such that a distal end portion of the ground electrode is disposed with being spaced from a distal end portion of the center electrode, wherein a hardness distribution is obtained by cutting the ground electrode from a distal end to a base end of the ground electrode at a cutting plane including an axial line of the spark plug and passing through a center of the ground electrode, and then measuring hardness of the ground electrode at a plurality of positions disposed with a distance from the base end of the ground electrode along a center line of the cutting plane of the ground electrode, the distance increasing in increments of 0.1 mm, a portion of the ground electrode from a position at a distance of 0.1 mm from the base end along the center line to the distal end is categorizable into a high hardness portion and a low hardness portion using the hardness distribution, the high hardness portion being a portion from the position at a distance of 0.1 mm from the base end along the center line to a position at a distance of 0.1×n (mm) from the base end along the center line, the low hardness portion being a portion from a position at a distance of 0.1×(n+1) (mm) from the base end along the center line to the distal end, wherein "n" is a natural number, the low hardness portion includes a portion that has a largest curvature in the ground electrode, and a highest hardness of the low hardness portion is lower than a lowest hardness of the high hardness portion.

2. The spark plug according to claim 1, wherein in the hardness distribution, hardness of the high hardness portion is higher than hardness of the portion that has the largest curvature.

3. The spark plug according to claim 1 or 2, wherein in the hardness distribution, a distal end portion of the high hardness portion that is an opposite side of the base end has the lowest hardness of the high hardness portion.

4. The spark plug according to claim 1 or 2, wherein the high hardness portion at least includes a portion to a position at a distance of 3 mm from the base end along the center line.

5. The spark plug according to claim 4, wherein in the hardness distribution, the lowest hardness of the high hardness portion from a position at a distance of 0.1 mm from the base end along the center line to the position at the distance of 3 mm from the base end along the center line is higher than hardness of the portion that has the largest curvature in the ground electrode by equal to or more than 20 Hv.

6. The spark plug according to claim 1, wherein in the hardness distribution, hardness at the position at a distance of 0.1 mm from the base end along the center line and hardness at a position at a distance of 0.1×n (mm) from the base end along the center line are lower than a highest hardness of the high hardness portion.

7. The spark plug according to claim 3, wherein the high hardness portion at least includes a portion to a position at a distance of 3 mm from the base end along the center line.

8. The spark plug according to claim 2, wherein in the hardness distribution, hardness at the position at a distance of 0.1 mm from the base end along the center line and hardness at a position at a distance of 0.1×n (mm) from the base end along the center line are lower than a highest hardness of the high hardness portion.

9. The spark plug according to claim 3, wherein in the hardness distribution, hardness at the position at a distance of 0.1 mm from the base end along the center line and hardness at a position at a distance of 0.1×n (mm) from the base end along the center line are lower than a highest hardness of the high hardness portion.

10. The spark plug according to claim 4, wherein in the hardness distribution, hardness at the position at a distance of 0.1 mm from the base end along the center line and hardness at a position at a distance of 0.1×n (mm) from the base end along the center line are lower than a highest hardness of the high hardness portion.

11. The spark plug according to claim 5, wherein in the hardness distribution, hardness at the position at a distance of 0.1 mm from the base end along the center line and hardness at a position at a distance of 0.1×n (mm) from the base end along the center line are lower than a highest hardness of the high hardness portion.

12. The spark plug according to claim 7, wherein in the hardness distribution, hardness at the position at a distance of 0.1 mm from the base end along the center line and hardness at a position at a distance of 0.1×n (mm) from the base end along the center line are lower than a highest hardness of the high hardness portion.

* * * * *